US006684938B2

(12) United States Patent
Tsujita et al.

(10) Patent No.: US 6,684,938 B2
(45) Date of Patent: Feb. 3, 2004

(54) EGR COOLER

(75) Inventors: Makoto Tsujita, Hino (JP); Keiichi Nakagome, Hino (JP); Katsuji Inoue, Hino (JP); Yoji Yamashita, Hachioji (JP)

(73) Assignees: Hino Motors, Ltd., Hino (JP); Sankyo Radiator Co., Ltd., Hachioji (JP)

( * ) Notice: Subject to any disclaimer, the term of this patent is extended or adjusted under 35 U.S.C. 154(b) by 0 days.

(21) Appl. No.: 10/356,611

(22) Filed: Feb. 3, 2003

(65) Prior Publication Data

US 2003/0111210 A1 Jun. 19, 2003

Related U.S. Application Data

(62) Division of application No. 09/889,389, filed as application No. PCT/JP00/00218 on Jan. 19, 2000, now abandoned.

(30) Foreign Application Priority Data

| | | |
|---|---|---|
| Jan. 20, 1999 | (JP) | 11-11776 |
| Jun. 4, 1999 | (JP) | 11-158053 |
| Sep. 6, 1999 | (JP) | 11-251546 |

(51) Int. Cl.[7] ..... F02M 25/07; F28D 7/16

(52) U.S. Cl. ..... 165/51; 165/158; 165/174; 165/179; 165/184; 123/568.12; 60/278; 60/320

(58) Field of Search ..... 165/51, 174, 158, 165/179, 184; 123/568.12; 60/320, 278

(56) References Cited

FOREIGN PATENT DOCUMENTS

| | | | | |
|---|---|---|---|---|
| DE | 1000194 | * | 1/1957 | ..... 165/174 |
| JP | 52-22706 | * | 6/1977 | |
| JP | 60-15877 | * | 4/1985 | |
| JP | 9-88614 | * | 3/1997 | |
| JP | WO 00/43663 | * | 7/2000 | |

* cited by examiner

*Primary Examiner*—John K. Ford
(74) *Attorney, Agent, or Firm*—Oblon, Spivak, McClelland, Maier & Neustadt, P.C.

(57) ABSTRACT

An EGR cooler including a flat box shell having an inlet for introducing cooling water and an outlet for discharging the cooling water, plates positioned at axial open ends of the shell to close the axial open ends thereof, hoods positioned at sides of the plates away from the shell to enclose end faces of the plates, tubes extending within the shell and having ends penetrating through the plates, the tubes for passing exhaust gas from one hood to the other for thermal exchange with the cooling water, guide plates curved away from the axial extension of the shell toward longer sides of the end face of the shell and provided in the hood on an inlet side of the exhaust gas, a bar positioned between the guide plates and extending in a direction of shorter sides of the end face of the shell for dividing a stream of the exhaust gas.

1 Claim, 11 Drawing Sheets

EGR COOLER

CROSS-REFERENCE TO RELATED APPLICATIONS

The present application claims priority to Japanese Application No. 11-11776, filed Jan. 20, 1999, Japanese Application No. 11-158053, filed Jun. 4, 1999, and Japanese Application No. 11-251546, filed Sep. 6, 1999. The present application also claims priority to the U.S. application Ser. No. 09/889,389, filed Jul. 17, 2001, now abandoned. The contents of those applications are incorporated herein by reference in their entirety.

TECHNICAL FIELD

This invention relates to an EGR cooler attached to an EGR apparatus, which recirculates exhaust gas from an engine to suppress generation of nitrogen oxides, so as to cool the exhaust gas for recirculation.

BACKGROUND ART

FIG. 1 is a sectional view showing a conventional EGR cooler in which reference numeral 1 denotes a cylindrical shell with axial opposite ends to which plates 2 are respectively fixed so as to close the ends of the shell 1. Penetratingly fixed to the respective plates 2 are opposite ends of a number of tubes 3 which extend in parallel with axial extension x of the shell 1. The tubes 3 extend axially within the shell 1.

The shell 1 is provided with cooling water inlet 4 in the vicinity of one end of the shell 1 and with cooling water outlet 5 in the vicinity of the other end of the shell 1 so that cooling water 9 is supplied via the cooling water inlet 4 into the shell 1, flows outside of the tubes 3 and is discharged via the cooling water outlet 5 out of the shell 1.

The respective plates 2 have, on their sides away from the shell 1, hoods 6A and 6B fixed to the plates 2 so as to enclose end faces of the plates 2. The one and the other hoods 6A and 6B provide central exhaust gas inlet and outlet 7 and 8, respectively, so that the exhaust gas 10 from the engine enters via the exhaust gas inlet 7 into the one hood 6A, is cooled, during passage through the tubes 3, by means of heat exchange with the cooling water 9 flowing outside of the tubes 3 and is discharged to the other hood 6B to be recirculated via the exhaust gas outlet 8 to the engine.

However, such conventional EGR cooler has a drawback of poor heat exchange efficiency since the exhaust gas 10 flows straight in the tubes 3 and is insufficiently contacted with inner peripheries of the tubes 3.

Moreover, as shown in FIG. 2 in an enlarged scale, the one hood 6A is composed of a tapered portion 6*x* divergent in a linear contour from the exhaust gas inlet 7 toward the shell 1 and a cylindrical portion 6*y* with substantially the same same diameter as that of the shell 1. With such construction, the flow of the exhaust gas 10 introduced via the exhaust gas inlet 7 tends to come off from the inner periphery of the tapered portion 6*x* to generate turbulence inside from the tapered portion 6*x* to the cylindrical portion 6*y*, leading to difficulty in introduction of the exhaust gas 10 into the tubes 3 arranged on the circumferential side of the plate 2. Such non-uniform distribution of the exhaust gas 10 to the respective tubes 3 also adversely affects on heat exchange efficiency and causes a fear that the tubes 3 on the central side may have higher temperature than that of the tubes 3 on the circumferential side, leading to local thermal deformation.

On the other hand, as shown in FIG. 3 in an enlarged scale, the other hood 6B is formed in the same manner as the one hood 6A described above, so that the exhaust gas 10 discharged out of the tubes 3 on the circumferential side collides against the tapered portion 6*x* of the hood 6A and is abruptly changed in direction of flow, which causes pressure increase of outlet portions of the tubes 3 on the circumferential side, which in turn provides ventilation resistance to the exhaust gas 10 in the tubes 3 on the circumferential side, resulting in much more difficulty in introducing the exhaust gas 10 to the tubes 3 on the circumferential side. This cause also results in non-uniform distribution of the exhaust gas 10 to the respective tubes 3 to thereby deteriorate the heat exchange efficiency and results in a fear that the temperature of the tubes 3 on the central side may be increased more than that of the tubes 3 on the circumferential side, leading to local thermal deformation.

Moreover, as shown in FIG. 4, the conventional arrangement of the tubes 3 is such that tubes 3 are arranged in staggered layout based on triangle as shown by two-dot chain line in the figure, which provides a relatively large clearance between the cylindrical shell 1 and the tubes 3 on the circumferential side. As a result, the cooling water 9 introduced via the cooling water inlet 4 tends to flow preferentially on the circumferential side where the flow resistance is low whereas the cooling water 9 flows insufficiently on the central side where the tubes 3 are arranged closely. Also due to this cause, the heat exchange efficiency in the tubes 3 on the central side is deteriorated than that in the tubes 3 on the circumferential side, causing a fear that the temperature of the tubes 3 on the central side may be increased more than that of the tubes 3 on the circumferential side to thereby cause local thermal deformation.

Furthermore, in the conventional EGR cooler described above, there is also a disadvantage that the cooling water 9 supplied via the cooling water inlet 4 to the shell 1 flows toward the cooling water outlet 5 non-uniformly with respect to cross section of the shell 1. As shown by a route 12 in FIG. 1, prevailing is the flow which, after flowing into the shell 1 via the cooling water inlet 4, crooks catercorner toward the cooling water outlet 5 to thereby result in stagnation of the cooling water 9 in the vicinity of corners in the shell 1 opposed to the cooling water inlet and outlet 4 and 5, respectively, thus providing cooling water stagnant areas 13; as a result, arises a problem that the heat exchange efficiency in these areas decreases. In particular, at a position diametrically opposed to the cooling water inlet 4 where the hot exhaust gas 10 is introduced, there is a fear that the tubes 3 may locally have high temperature in the vicinity of the cooling water stagnant area 13, causing thermal deformation.

FIGS. 5 and 6 show a further conventional EGR cooler. With the EGR cooler shown here, a shell 1 is formed in a box shape flattened longitudinally (perpendicular to the axial extension x of the shell 1) due to issues raised in mounting it on a vehicle. The respective hoods 6A and 6B are diverged outwardly of the longer sides of the end faces of the shell 1 (vertically in the example shown in the figure) from the exhaust gas inlet and outlet 7 and 8, respectively, to the shell 1 so as to wholly enclose the end faces of the respective plates 2.

In the EGR cooler formed in such flattened box shape, the exhaust gas 10 introduced via the exhaust gas inlet 7 into the hood 6A tends to flow straight in the flow direction at the time of being introduced and is hardly diffused outwardly of the longer sides of the end face of the shell 1; also arises a disadvantage that the gas flow tends to come off in the hood 6A in the vicinity of the exhaust gas inlet 7 to readily cause turbulence. As a result, there is a fear that the exhaust gas 10 may flow one-sidedly into the tubes 3 centrally of the longer side of the end face of the shell 1 so that the temperature of the tubes 3 in question may increase mainly on the inlet side of the exhaust gas 10, thereby causing local thermal deformation, whereas the amount of the exhaust gas 10 distributed to the tubes 3 outwardly of the longer sides of the end face of the shell 1 is insufficient, causing a problem that the heat exchange efficiency in this area decreases.

FIG. 7 shows a still further conventional EGR cooler. With this EGR cooler shown here, the hoods are omitted due to issues raised in mounting it on a vehicle, and gas pipings 11 extending substantially perpendicular to the axial extension x of the shell 1 are bent or turned by about 90 degrees to and directly connected with opposite ends of the shell 1. Ends of the respective gas pipings 11 on the sides connected to the shell 1 are shaped in the form of bowls imitating the conventional hoods 6A and 6B (see FIG. 1) in the prior art shown in FIGS. 1 to 4.

In such type of EGR cooler, which has the gas pipings 11 bent or turned substantially perpendicular to and connected with the opposite ends of the shell 1, the gas flow comes off from inside of the turn to readily cause turbulence particularly on the inlet side of the exhaust gas 10 due to the abrupt bent or turn of the gas piping 11; therefore, there is a fear that the exhaust gas 10 may tend to flow one-sidedly into the tubes 3 which confront outside of the turn and the tubes 3 in question increases in temperature on the inlet side of the exhaust gas 10 to cause local thermal deformation whereas the amount of the exhaust gas 10 distributed to the tubes 3 which confront inside of the turn is insufficient, causing a problem that the heat exchange efficiency in this area decreases.

In view of the above facts, the present invention was made to provide an EGR cooler which can improve the heat exchange efficiency of the exhaust gas with the cooling water more than before and which, particularly in a case where local thermal deformation may occur, can prevent such thermal deformation from occurring.

SUMMARY OF THE INVENTION

An EGR cooler according to one aspect of the present invention comprises tubes and a shell enclosing said tubes, cooling water being supplied into and discharged from said shell, exhaust gas being passed through said tubes for thermal exchange of said exhaust gas with said cooling water, and is characterized in that the tube is formed, on an inner periphery thereof, with a plurality of streaks of spiral protrusions.

Such formation of the plurality of streaks of spiral protrusions on the inner periphery of the tube causes the exhaust gas passing through the tube to be whirled along the spiral protrusions into turbulence and increases contact frequency and contact distance thereof to the inner periphery of the tube. As a result, the exhaust gas is contacted with the inner periphery of the tube evenly and sufficiently, substantially improving the heat exchange efficiency of the EGR cooler.

Suppose that only one streak of spiral protrusion is formed on the inner periphery of the tube and its pitch is made closer; then, the inclination angle of the spiral protrusion to the exhaust flow 10 increases and approaches a right angle, resulting in increase of the pressure loss. However, according to the invention which is formed with especially a plurality of streaks of spiral protrusions, even if pitch between the spiral protrusions is made closer, the inclination angle of the spiral protrusions to the flow of the exhaust gas can be suppressed, whereby whirl force can be increased without increase of the pressure loss.

An EGR cooler according to another aspect of the present invention comprises tubes and a shell enclosing said tubes, cooling water being supplied into and discharged from said shell, exhaust gas being passed through said tubes for thermal exchange of said exhaust gas with said cooling water, and is characterized in that a spiral wire rod is fitted into the tube.

Such fitting of the spiral wire rod into the tube causes the exhaust gas passing through the tube to be whirled along the spiral wire rod into turbulence, and increases contact frequency and contact distance thereof to the inner periphery of the tube. As a result, the exhaust gas is contacted with the inner periphery of the tube evenly and sufficiently, substantially improving the heat exchange efficiency of the EGR cooler.

An EGR cooler according to yet another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hoods to the other hood for thermal exchange of said exhaust gas with said cooling water, and is characterized in that the hood on an inlet side of the exhaust gas is formed in a bellmouth shape with a concave face facing outward so as to gradually increase the diameter in the flow direction of the exhaust gas.

This enhances the tendency of the exhaust gas flowing in laminar flow along the inner periphery of the hood without coming off; and hence turbulence hardly occurs in the circumferential portion in the hood, making it easy to introduce the exhaust gas to the tubes arranged on the circumferential side just as the tubes on the central side. As a result, the exhaust gas is uniformly distributed to the respective tubes to thereby substantially increase the heat exchange efficiency; moreover, the tubes on the central side and the tubes on the circumferential side can be uniformly heated to thereby avoid thermal deformation due to local high temperature.

An EGR cooler according to still another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hoods to the other hood for thermal exchange of said exhaust gas with said cooling water, and is characterized in that the hood on an outlet side of the exhaust gas is formed in a bowl shape with a convex face facing outward so as to gradually decrease the diameter in the flow direction of the exhaust gas.

This causes the exhaust gas, which is discharged out of the tubes on the circumferential side, to form laminar flow along the inner periphery of the hood and smoothly change the direction of the flow. Hence, pressure increase hardly occurs at the outlet portion of the tubes on the circumferential side, which decreases ventilation resistance of the exhaust gas in the tubes on the circumferential side, making it easy to introduce the exhaust gas to the tubes arranged on the circumferential side just as the tubes on the central side. As a result, the exhaust gas is uniformly distributed to the respective tubes to thereby substantially increase the heat exchange efficiency; moreover, the tubes on the central side and the tubes on the circumferential side can be uniformly heated so that thermal deformation due to local high temperature is avoided.

An EGR cooler according to still another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hoods to the other hood for thermal exchange of said exhaust gas with said cooling water, and is characterized in that the respective tubes are arranged in multi-concentric circles about the axis of the shell.

This enables the tubes on the circumferential side to be arranged along the cylindrical shell, thereby substantially reducing the clearance between them and substantially suppressing a tendency that the cooling water introduced into the shell preferentially flows on the circumferential side. In addition, upon arrangement of the same number of tubes having the same diameter as the conventional case, the gap between the respective tubes can be secured wider than before and the cooling water can be sufficiently supplied even into the tubes on the central side. Hence, the tubes on the central side and the tubes on the circumferential side can be uniformly cooled to thereby avoid local high temperature, substantially improving the heat exchange efficiency of the exhaust gas with the cooling water.

An EGR cooler according to still another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hoods to the other hood for thermal exchange of said exhaust gas with said cooling water, and is characterized in that the shell is provided, at one of axial ends thereof, with a cooling water inlet for introduction of cooling water into said shell and, at the other axial end of the shell, with a cooling water outlet for discharge of the cooling water out of said shell, there being provided a bypass outlet for pulling out part of the cooling water introduced via the cooling water inlet, at a position diametrically opposed to the cooling water inlet at the one axial end of the shell.

Thus, when part of the introduced cooling water is pulled out via the bypass outlet while introducing the cooling water via the cooling water inlet into the shell, no cooling water stagnates at a position diametrically opposed to the cooling water inlet at the one axial end of the shell and no cooling water stagnant are is formed here. As a result, local high temperature in the tubes on the one axial end of the shell is averted to substantially improve the heat exchange efficiency of the exhaust gas with the cooling water.

An EGR cooler according to still another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hoods to the other hood for thermal exchange of said exhaust gas with said cooling water, and is characterized in that the hood on an inlet side of the exhaust gas is formed in a bellmouth shape in section with abrupt divergency from the exhaust gas inlet opened on the axial extension of the shell toward the shell in the direction of the longer sides of the end face of the shell, to thereby wholly enclose the end face of the plate, and having a curved portion adjacent to the exhaust gas inlet curved in a concave face facing outward, that a pair of guide plates arcuately curved from a direction along the axial extension of the shell to outward of the longer sides of the end face of the shell are arranged in the form of a funnel, in the hood on the inlet side of the exhaust gas at a position facing to the exhaust gas inlet, and that arranged at an intermediate position between the respective guide plates is a round bar extending in the direction of the shorter sides of the end face of the shell for dividing a main stream of the exhaust gas.

This smoothly changes the direction of the flow by means of the respective guide plates and favorably scatters the exhaust gas, introduced via the exhaust gas inlet, outward of the longer sides of the end face of the shell. Moreover, the flow of the exhaust gas having passed through between the respective guide plates collides against the round bar and divided to be favorably scattered. Furthermore, the gas flow does not come off along the curved surface, to increase the tendency of forming laminar flow in the vicinity of the exhaust gas inlet in the hood, and hence turbulence of the gas flow hardly occurs in the hood on the inlet side of the exhaust gas, making it easy to introduce the exhaust gas also to the tubes arranged outwardly in the direction of the longer sides of the end face of the shell. As a result, the exhaust gas is introduced and distributed to all the tubes substantially uniformly, to avoid local high temperature of the tubes, thereby substantially improving the heat exchange efficiency of the exhaust gas with the cooling water.

An EGR cooler according to still another aspect of the present invention comprises a cylindrical shell, plates fixed to axial opposite ends of said shell so as to close the ends of the shell, hoods fixed to sides of the plates away from said shell so as to enclose end faces of the plates, tubes extending axially within the shell and having opposite ends penetratingly fixed to the respective plates, cooling water being supplied into and discharged from said shell, exhaust gas being passed through said tubes from one of the hood to the other hood for thermal exchange of said exhaust gas with said cooling water, and is characterized in that gas pipings extending substantially perpendicular to axial extension of the shell are gradually increased in diameter and gradually bent or turned to the axial opposite ends of the shell such that the gas flow does not come off, and is connected to the shell such that the axial extension x of the shell 1 and the axial line of each gas piping cross each other with a predetermined angle.

This smoothly changes the direction of the flow of the exhaust gas, which is guided toward the axial one end of the shell, such that the exhaust gas forms laminar flow along an inner periphery of the gas piping and that the direction of the flow after being changed is not completely aligned with the axial direction of the shell, resulting in collision of the gas flow with uniform flow rate distribution against the plate on the axial one end of the shell, whereby the exhaust gas can be introduced and distributed substantially uniformly with no bias to all the tubes while turbulence of the gas flow on the side of the axial one end of the shell is suppressed. On the other hand, the exhaust gas coming out through each tube to the side of the axial other end of the shell is also smoothly changed in direction of flow to form laminar flow along the inner periphery of the gas piping and is smoothly discharged at the outlet portion of each tube, without being subjected to local ventilation resistance. As a result, local high temperature of the tubes is averted and heat exchange efficiency of the exhaust gas with the cooling water is substantially improved.

BEST MODE FOR CARRYING OUT THE INVENTION

Now, embodiments of the invention will be described in conjunction with illustrated examples.

Figure 1:
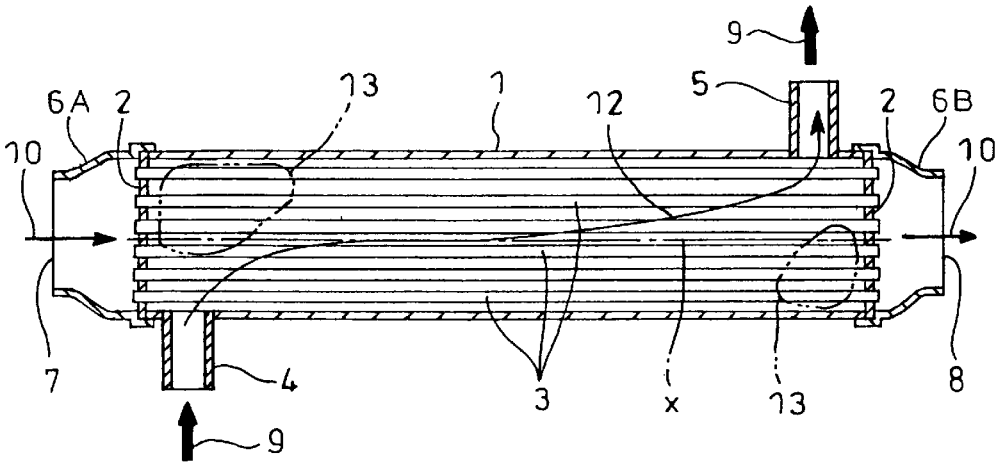
Fig. 1 Prior Art
FIG. 1 is a sectional view showing a conventional EGR cooler.
Figure 2:
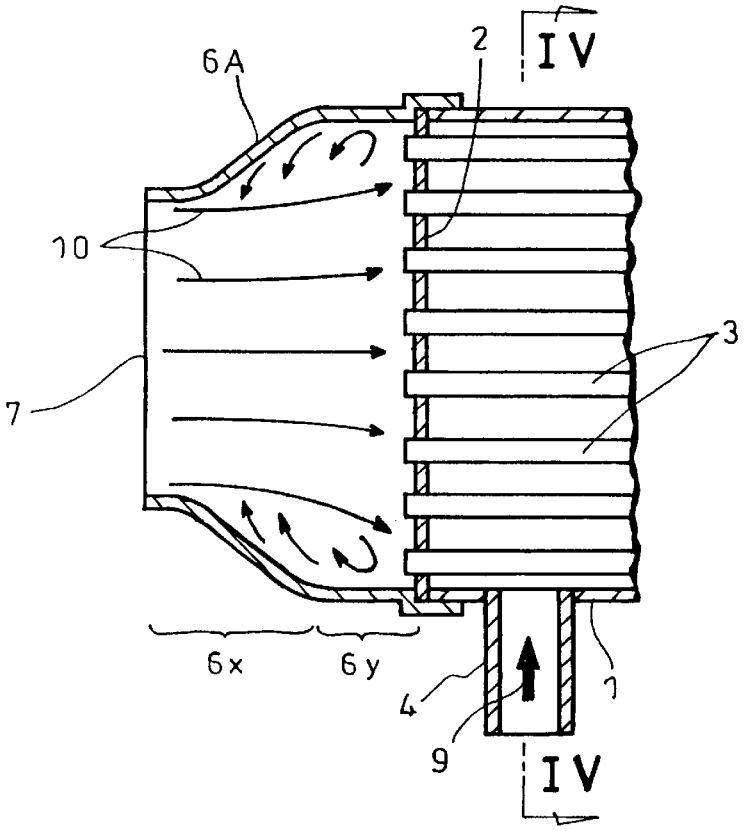
Fig. 2 Prior Art
FIG. 2 is a sectional view showing details of a hood on an inlet side of exhaust gas in FIG. 1.
Figure 3:
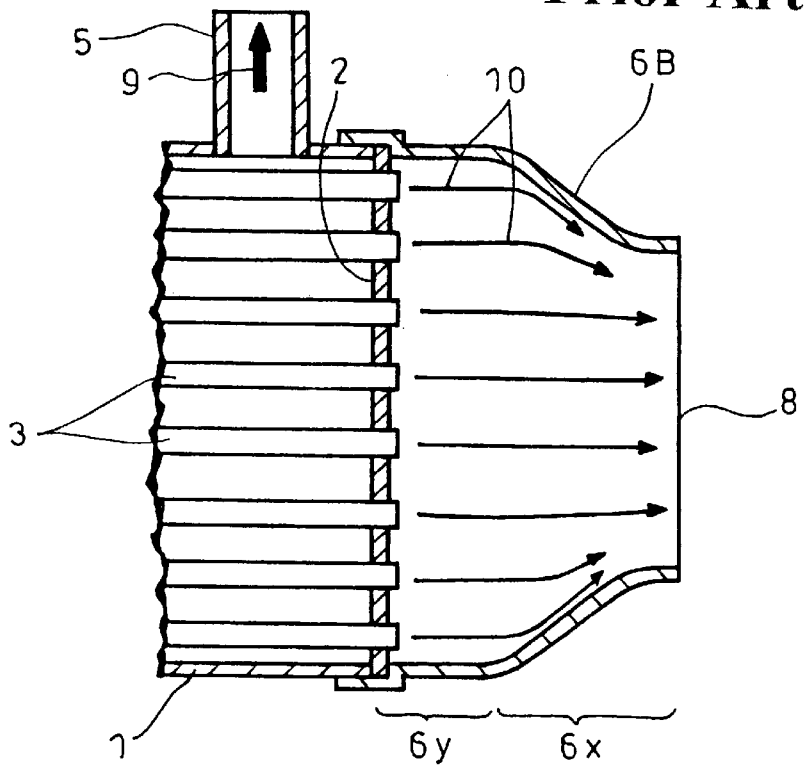
Fig. 3 Prior Art
FIG. 3 is a sectional view showing details of a hood on an outlet side of the exhaust gas in FIG. 1.
Figure 8:
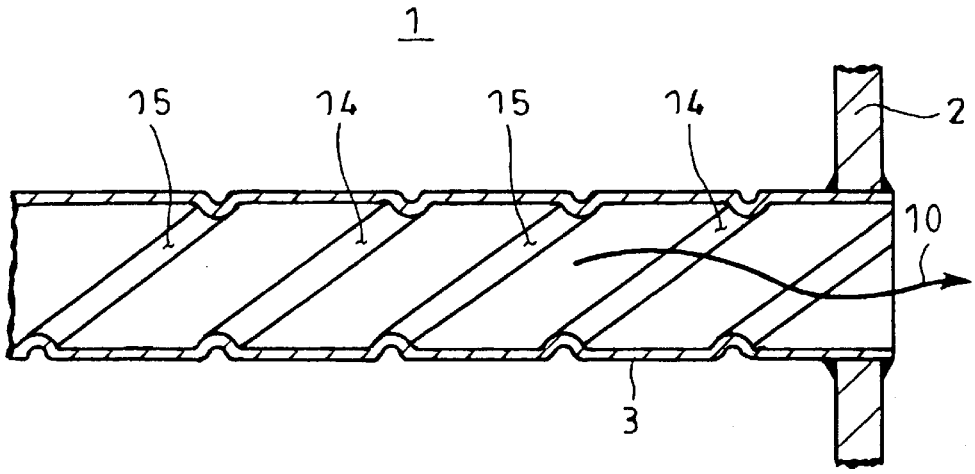
FIG. 8 is an enlarged sectional view showing an embodiment of the invention.

FIG. 8 is an enlarged sectional view showing an embodiment of the present invention in which the same parts as those in FIG. 1 are denoted by the same reference numerals.

In this embodiment, with respect to an EGR cooler constructed substantially in the same manner as that described above with reference to FIG. 1, each tube 3 extend through plates 2 and has a plurality of streaks (two streaks in the embodiment shown in FIG. 8) of spiral protrusions 14 and 15 on an inner periphery of the tube 3.

In a case where the tube 3 has a thin wall thickness, the plurality of streaks of spiral protrusions 14 and 15 are formed by spirally indenting the tube 3 from outside by means of a roll or the like having spiral convex streaks so that pressed portions from outside provide the plurality of streaks of spiral protrusions 14 and 15 on the inner periphery of the tube 3.

When, as shown in FIG. 8, for example, two steaks of spiral protrusions 14 and 15 mutually different in phase by 180 degrees in the circumferential direction coexist on the inner periphery of the tube 3, the spiral protrusions 14 and 15 diametrically opposed to each other are counter-crossed with each other at each position in the longitudinal direction, which increases strength against the bending stress of the tube 3.

In the case of a tube 3 having a thick wall thickness, however, the plurality of streaks of spiral protrusions 14 and 15 may be formed by cutting the inner periphery of the tube 3 so as to leave the plurality of streaks of spiral protrusions 14 and 15.

Such formation of the plurality of streaks of spiral protrusions 14 and 15 on the inner periphery of the tube 3 causes the exhaust gas 10 passing through the tube 3 to be whirled along the spiral protrusions 14, 15 into turbulence, and increases contact frequency and contact distance thereof to the inner periphery of the tube 3. As a result, the exhaust gas 10 is contacted with the inner periphery of the tube 3 evenly and sufficiently, enabling substantial improvement in the heat exchange efficiency of the EGR cooler.

Figure 9:
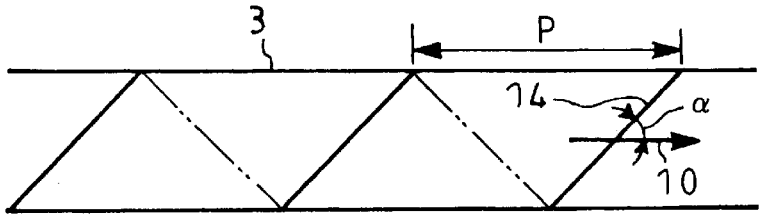
FIG. 9 is a schematic cross-section of an exemplary tube.
Figure 10:
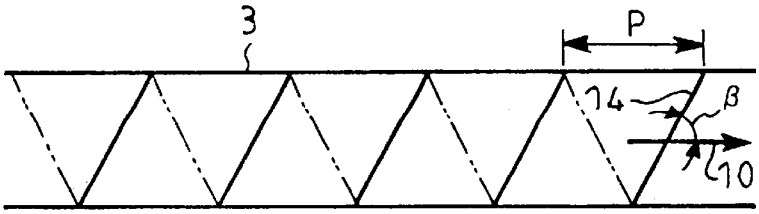
FIG. 10 is a schematic cross-section of another exemplary tube.
Figure 11:
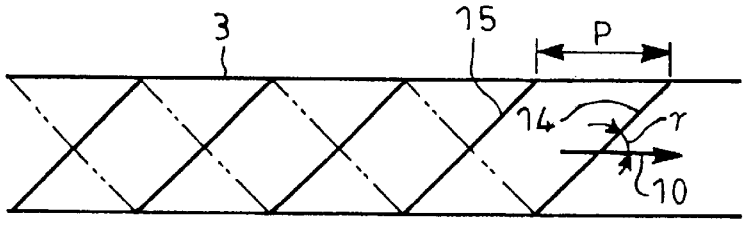
FIG. 11 is a schematic cross-section of a tube having spiral protrusions.

Suppose that, for example, as schematically shown in FIG. 9, only one streak of spiral protrusion 14 is formed on the inner periphery of the tube 3 at an inclination angle $\alpha$ to the flow of the exhaust gas 10; then, pitch P of the spiral protrusion 14 is made closer as shown in FIG. 10, the inclination angle of the spiral protrusion 14 increases into $\beta$ and approaches a right angle, resulting in increase of the pressure loss. However, in this embodiment where the plurality of streaks of spiral protrusions 14 and 15 are formed, even if pitch P between the spiral protrusions 14 and 15 is made closer as shown in FIG. 11, the inclination angle $\gamma$ of the spiral protrusions 14 and 15 to the flow of the exhaust gas 10 can be suppressed, whereby whirl force can be increased without increase of the pressure loss.

Figure 12:
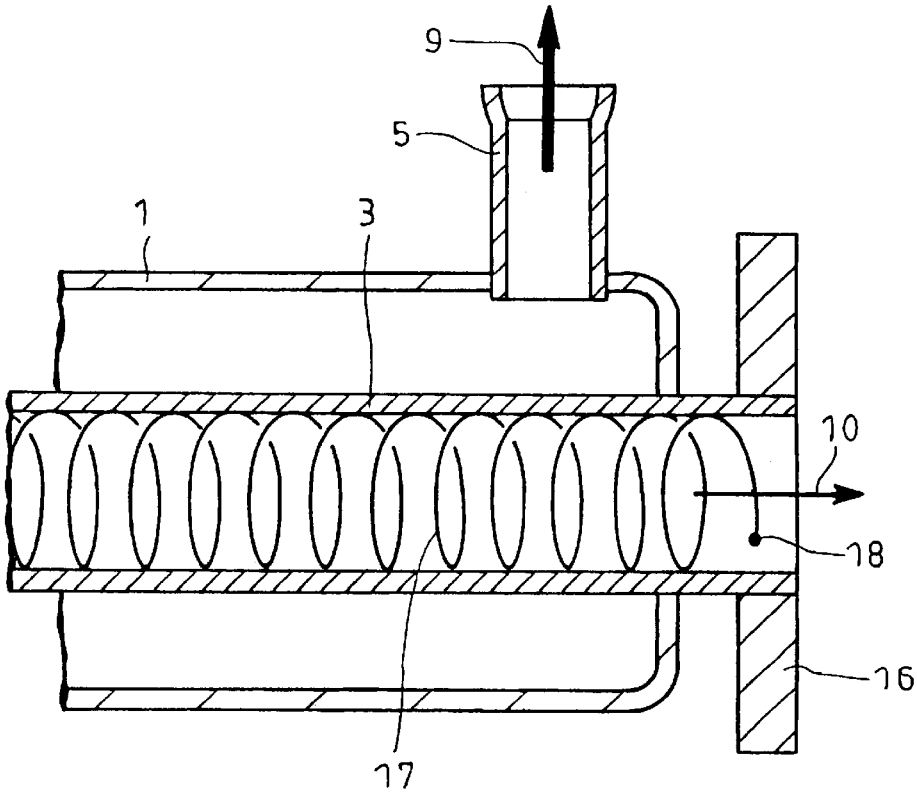
FIG. 12 is an enlarged sectional view showing another embodiment of the present invention.

FIG. 12 is an enlarged sectional view showing another embodiment of the present invention. Adopted in this embodiment is a structure with a shell 1 formed as a cylindrical container, opposite ends of each tube 3 passing through and being fixed to axial opposite ends of the shell 1, respectively. The tube 3 is of increased diameter and of increased wall thickness so that the flow cross sectional area and strength are enhanced to reduce the required number of tubes 3 to the minimum.

Fitted over a tip of the tube 3 projected outside of the shell 1 is a gas flange 16 to which line for recirculation of the exhaust gas 10 is directly connected in branched manner.

With respect to the EGR cooler thus constructed, a spiral wire rod 17 in a form of a coiled spring is fitted in the tube 3 substantially over the whole length thereof; opposite ends of this spiral wire rod 17 are fixed to the inner periphery of the tube 3 by welding 18.

That is to say, the embodiment shown in FIG. 12 is suitable for a case where the diameter and the wall thickness of the tube 3 are large, and has an advantage that machining is easier than the case where the above-mentioned spiral protrusions 14 and 15 as shown in FIG. 8 are formed.

The exhaust gas 10 passing through the tube 3 is whirled along the spiral wire rod 17 into turbulence, and its contact frequency and contact distance to the inner periphery of the tube 3 increase. As a result, the exhaust gas 10 is contacted with the inner periphery of the tube 3 evenly and sufficiently, enabling substantial improvement in the heat exchange efficiency of the EGR cooler.

Figure 13:
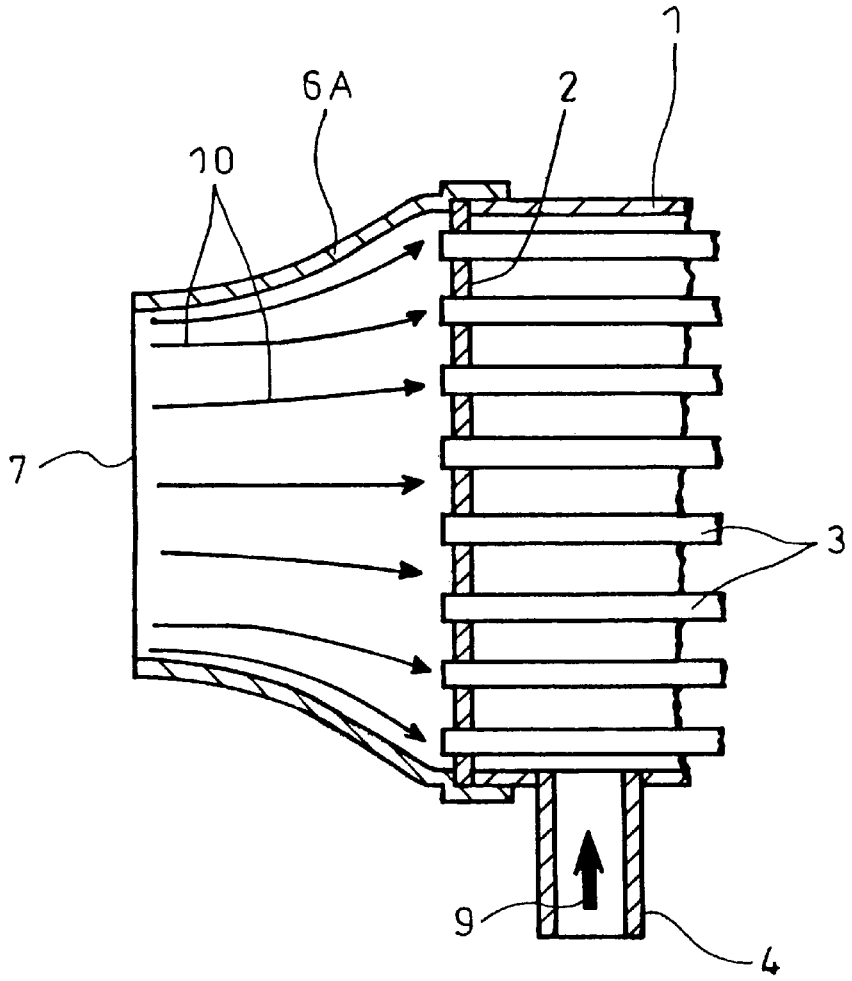
FIG. 13 is a sectional view showing yet another embodiment of the present invention.

FIG. 13 shows yet another embodiment of the present invention. In this embodiment, with respect to an EGR cooler constructed substantially in the same manner as that described above with reference to FIG. 1, a hood 6A on the inlet side of the exhaust gas 10 is formed in a bellmouth shape with a concave face facing outward so as to gradually increase the diameter in the flow direction of the exhaust gas 10.

This enhances the tendency of the exhaust gas 10, which is introduced via the exhaust gas inlet 7, forming laminar flow along the inner periphery of the hood 6A without coming-off, and hence turbulence hardly occurs in the circumferential portion in the hood 6A, making it easy to introduce the exhaust gas 10 to the tubes 3 arranged on the circumferential side just as the tubes 3 on the central side. As a result, the exhaust gas 10 is uniformly distributed to the respective tubes 3 to thereby substantially increase the heat exchange efficiency; moreover, the tubes 3 on the central side and the tubes 3 on the circumferential side can be uniformly heated to thereby avoid a thermal deformation due to local high temperature.

Figure 14:
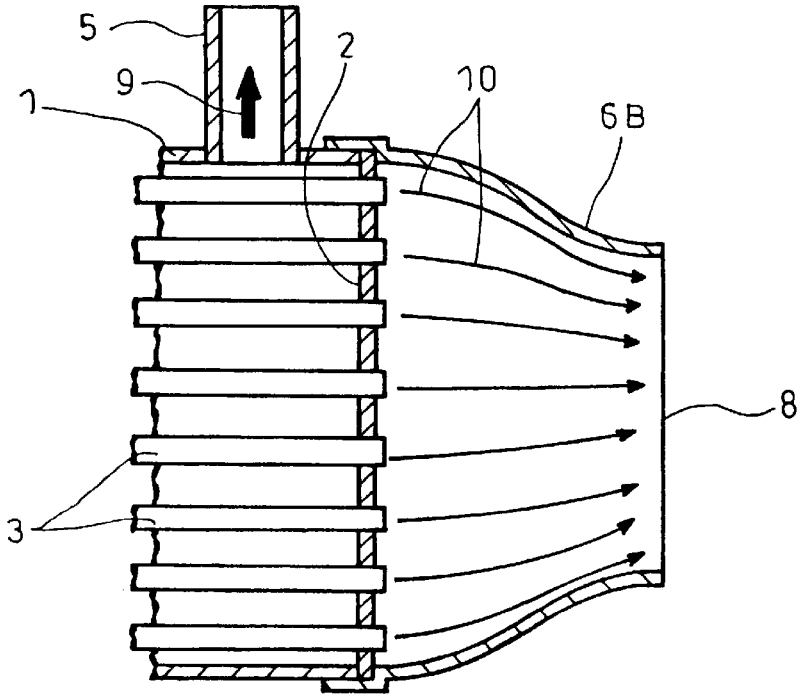
FIG. 14 is a sectional view showing still another embodiment of the present invention.

FIG. 14 shows still anther embodiment of the present invention. In this embodiment, with respect to an EGR cooler constructed substantially in the same manner as the EGR cooler described above with reference to FIG. 1, a hood 6B on the outlet side of the exhaust gas 10 is formed in a bowl shape with a convex face facing outward so as to gradually decrease the diameter in the flow direction of the exhaust gas 10.

This enables the exhaust gas 10, which is discharged out of the tubes 3 on the circumferential side, to form laminar flow along the inner periphery of the hood 6B and to smoothly change the direction of the flow. Hence, pressure increase hardly occurs at the outlet portion of the tubes 3 on the circumferential side, which decreases ventilation resistance of the exhaust gas 10 in the tubes 3 on the circumferential side, making it easy to introduce the exhaust gas 10 to the tubes 3 arranged on the circumferential side just as the tubes 3 on the central side. As a result, the exhaust gas 10 is uniformly distributed to the respective tubes 3 to thereby substantially increase the heat exchange efficiency; moreover, the tubes 3 on the central side and the tubes 3 on the circumferential side can be uniformly heated to thereby avoid thermal deformation due to local high temperature.

Figure 4:
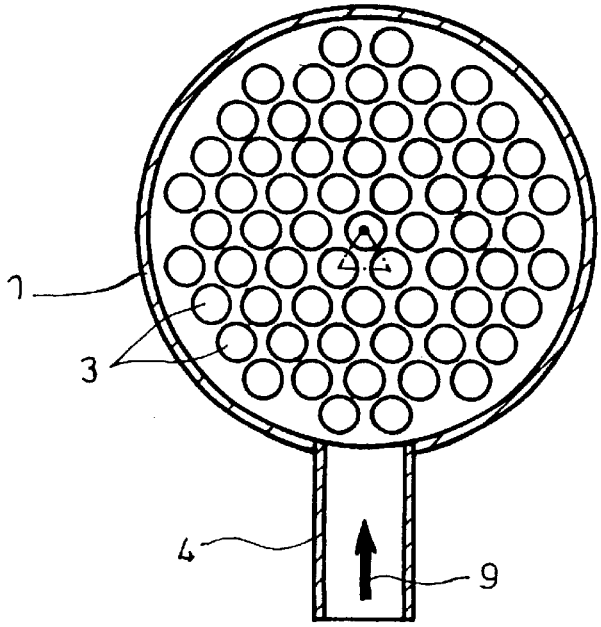
Fig. 4 Prior Art
FIG. 4 is a sectional view looking in the direction of arrows IV in FIG. 2.
Figure 15:
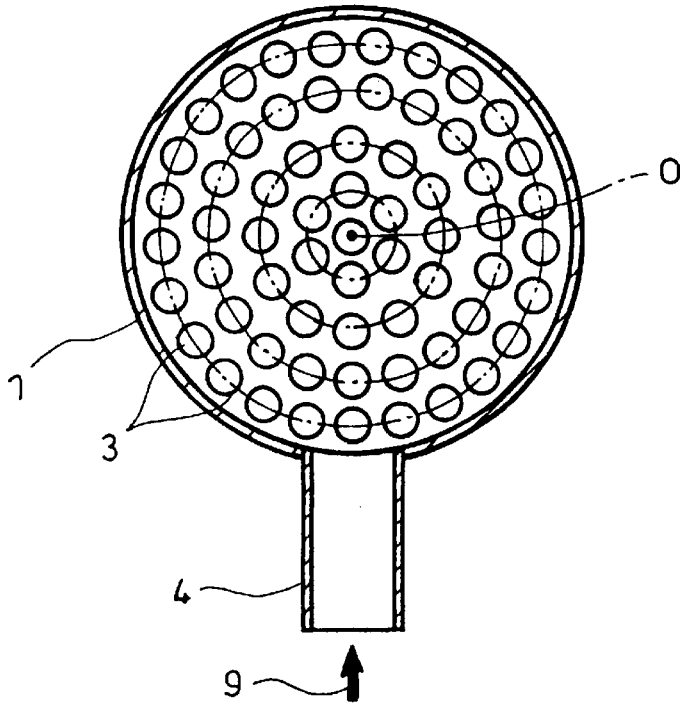
FIG. 15 is a sectional view showing still another embodiment of the present invention.

FIG. 15 shows still another embodiment of the present invention. In this embodiment, with regard to an EGR cooler constructed substantially in the same manner as that described above with reference to FIG. 1, the respective tubes 3 are arranged in multi-concentric circles about the axis O of the shell 1. In the illustration in FIG. 15, the same number of tubes 3 having the same diameter as in FIG. 4 are arranged.

This enables the tubes 3 on the circumferential side to be arranged along the cylindrical shell 1, to thereby substantially reduce the clearance between them and suppress a tendency that the cooling water 9 introduced into the shell 1 via the cooling water inlet 4 preferentially flows on the circumferential side. In addition, upon arrangement of the same number of tubes 3 having the same diameter as the conventional case, the gap between the respective tubes 3 can be secured wider than before and the cooling water 9 can be sufficiently supplied even into the tubes 3 on the central side. Hence, the tubes 3 on the central side and the tubes 3 on the circumferential side can be uniformly cooled to thereby avoid local high temperature, enabling substantial improvement in the heat exchange efficiency between the exhaust gas 10 and the cooling water 9.

Figure 16:
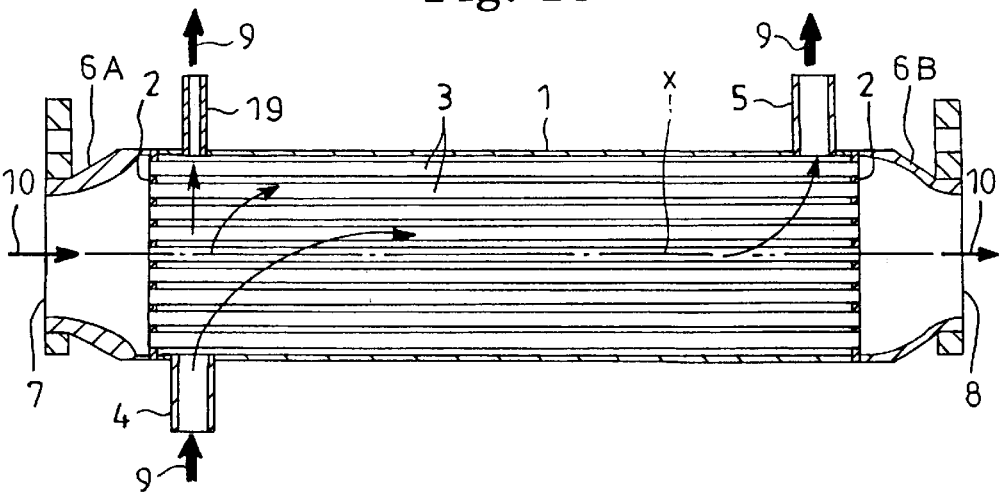
FIG. 16 is a sectional view showing still another embodiment of the present invention.

FIG. 16 shows still another embodiment of the present invention. In this embodiment, with respect to an EGR cooler constructed substantially in the same manner as that described above with reference to FIG. 8, there is provided a bypass outlet 19 for pulling out part of the cooling water 9 introduced via the cooling water inlet 4, at a position diametrically opposed to the cooling water inlet 4 at one axial end of the shell 1.

Thus, the exhaust gas 10 of the engine enters via the exhaust gas inlet 7, passing through the one hood 6A, scatters and passes through the plurality of tubes 3, enters into the other hood 6B and is recirculated to the engine via the exhaust gas outlet 8; on the other hand, the cooling water 9 is supplied via the cooling water inlet 4 into the shell 1 and flows towards the cooling water outlet 5. At this time, if part of the introduced cooling water 9 is pulled out via the bypass outlet 19 while introducing the cooling water 9 via the cooling water inlet 4 into the shell 1, no cooling water 9 stagnates at a position diametrically opposed to the cooling water inlet 4 at the one axial end of the shell 1, and hence no cooling water stagnant area is formed here. As a result, local high temperature in the tubes 3 on the one axial end of the shell 1 is averted, thereby substantial improving the heat exchange efficiency of the exhaust gas 10 with the cooling water 9.

Figure 5:
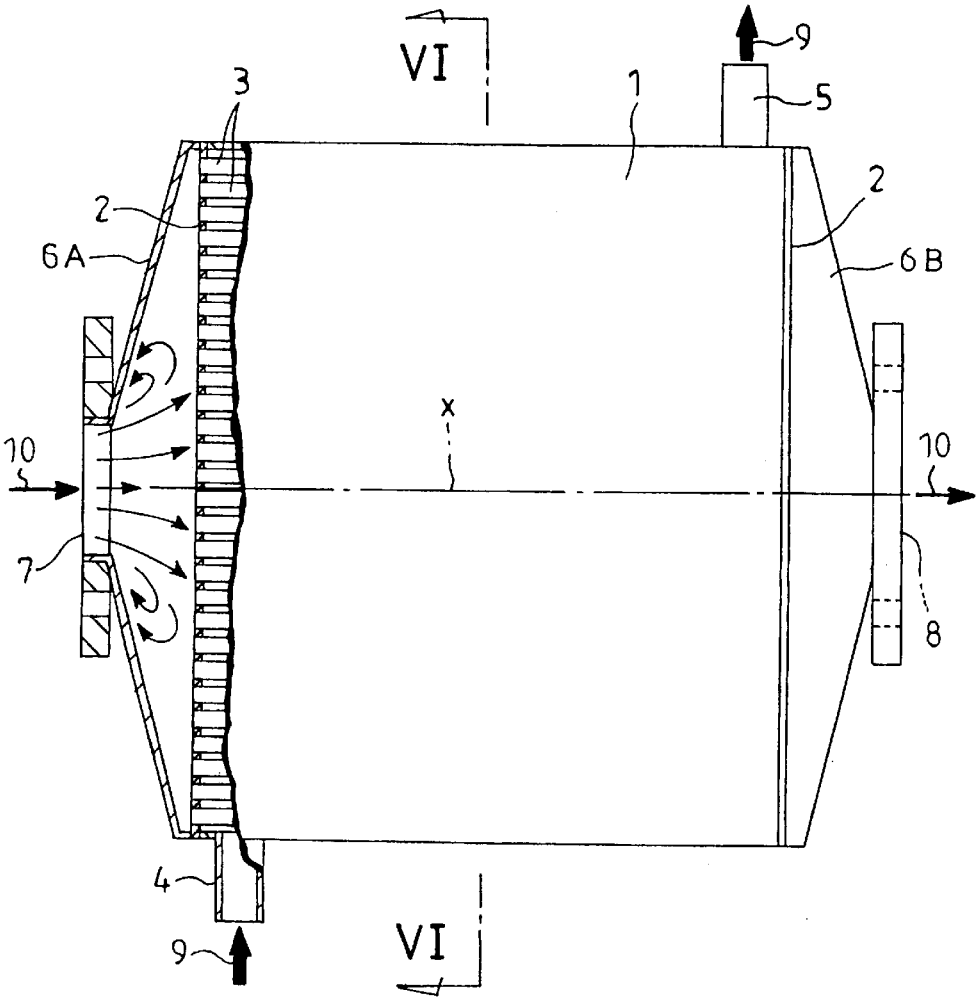
Fig. 5 Prior Art
FIG. 5 is a sectional view showing a further conventional EGR cooler.
Figure 6:
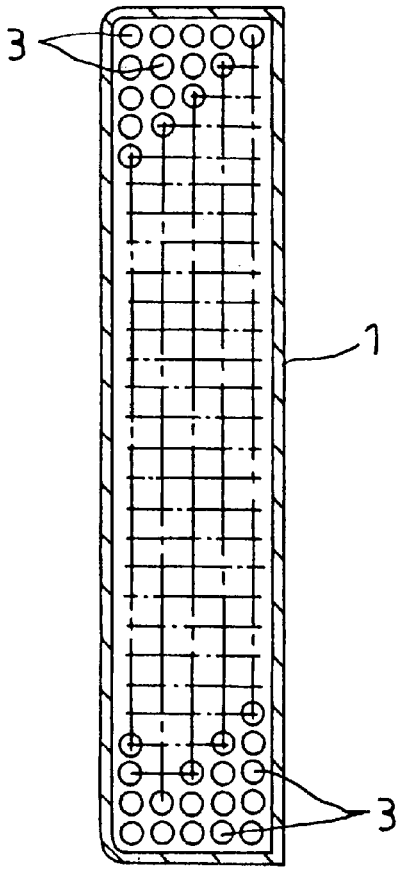
Fig. 6 Prior Art
FIG. 6 is a sectional view looking in the direction of arrows VI in FIG. 5.
Figure 17:
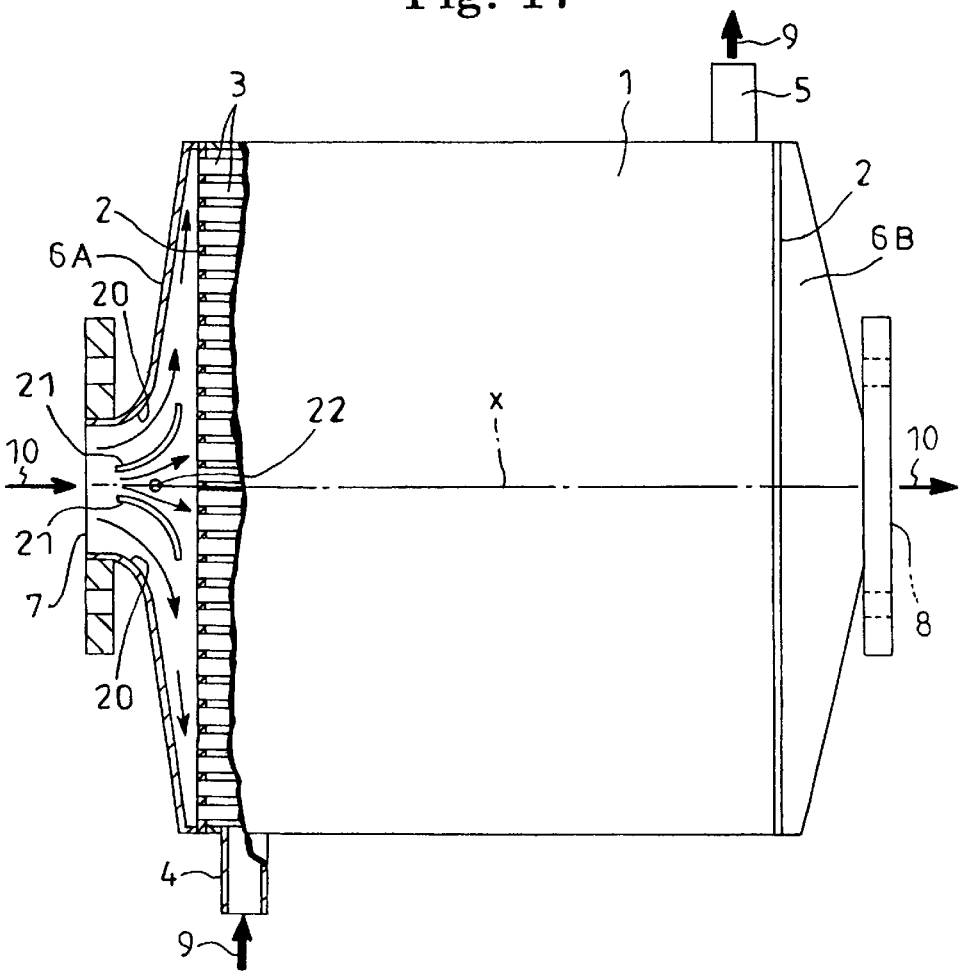
FIG. 17 is a sectional view showing still another embodiment of the present invention.

FIG. 17 shows still another embodiment of the present invention. In this embodiment, with respect to an EGR cooler constructed substantially in the same manner as that described above with reference to FIGS. 5 and 6, a hood 6A on the inlet side of the exhaust gas 10 is formed in a bellmouth shape in section with abrupt divergency from the exhaust gas inlet 7 opened on the axial extension x of the shell 1 toward the shell 1 in the direction of the longer sides (in vertical direction in the example shown in the figure) of the end face of the shell 1 to thereby wholly enclose the end face of the plate 2, and having a curved portion 20 adjacent to the exhaust gas inlet 7 curved in a concave face facing outward so that the gas flow does not come off. A pair of guide plates 21 arcuately curved from a direction along the axial extension x of the shell 1 to outward of the direction of the longer side of the end face of the shell 1 are arranged in the form of a funnel, in the hood 6A on the inlet side of the exhaust gas at a position facing to the exhaust gas inlet 7. Arranged at an intermediate position between the respective guide plates 21 is a round bar 22 extending in the direction of the shorter sides (corresponding to the right and left direction in FIG. 6) of the end face of the shell 1 for dividing the main stream of the exhaust gas 10.

This smoothly changes the direction of the flow by means of the respective guide plates to favorably scatter the exhaust gas 10, introduced via the exhaust gas inlet 7 into the hood 6A, outward of the longer sides of the end face of the shell 1. Also, the flow of the exhaust gas 10 having passed through between the respective guide plates 21 collides against the round bar 22 and divided to be favorably scattered. Moreover, the gas flow does not come off along the curved surface 20, to increase the tendency of flowing in laminar flow in the vicinity of the exhaust gas inlet 7 in the hood 6A, and hence turbulence of the gas flow hardly occurs in the hood 6A on the inlet side of the exhaust gas 10, making it easy to introduce the exhaust gas 10 also to the tubes 3 arranged outwardly of the longer sides of the end face of the shell 1. As a result, the exhaust gas 10 is introduced and distributed to all the tubes 3 substantially uniformly to avoid local high temperature of the tubes 3, thereby substantially improving the heat exchange efficiency between the exhaust gas 10 and the cooling water 9.

Figure 7:
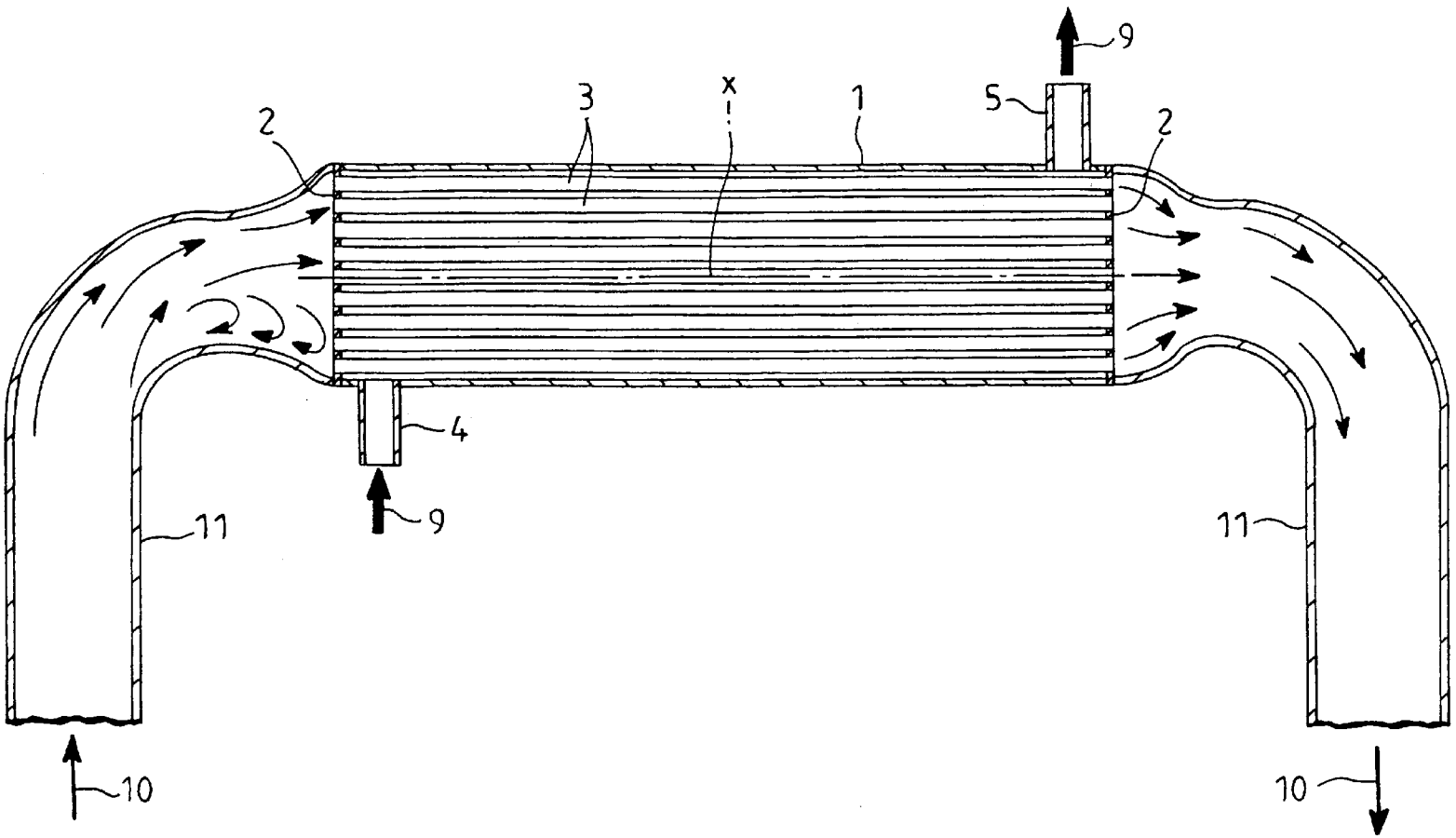
Fig. 7 Prior Art
FIG. 7 is a sectional view showing a still further conventional EGR cooler.
Figure 18:
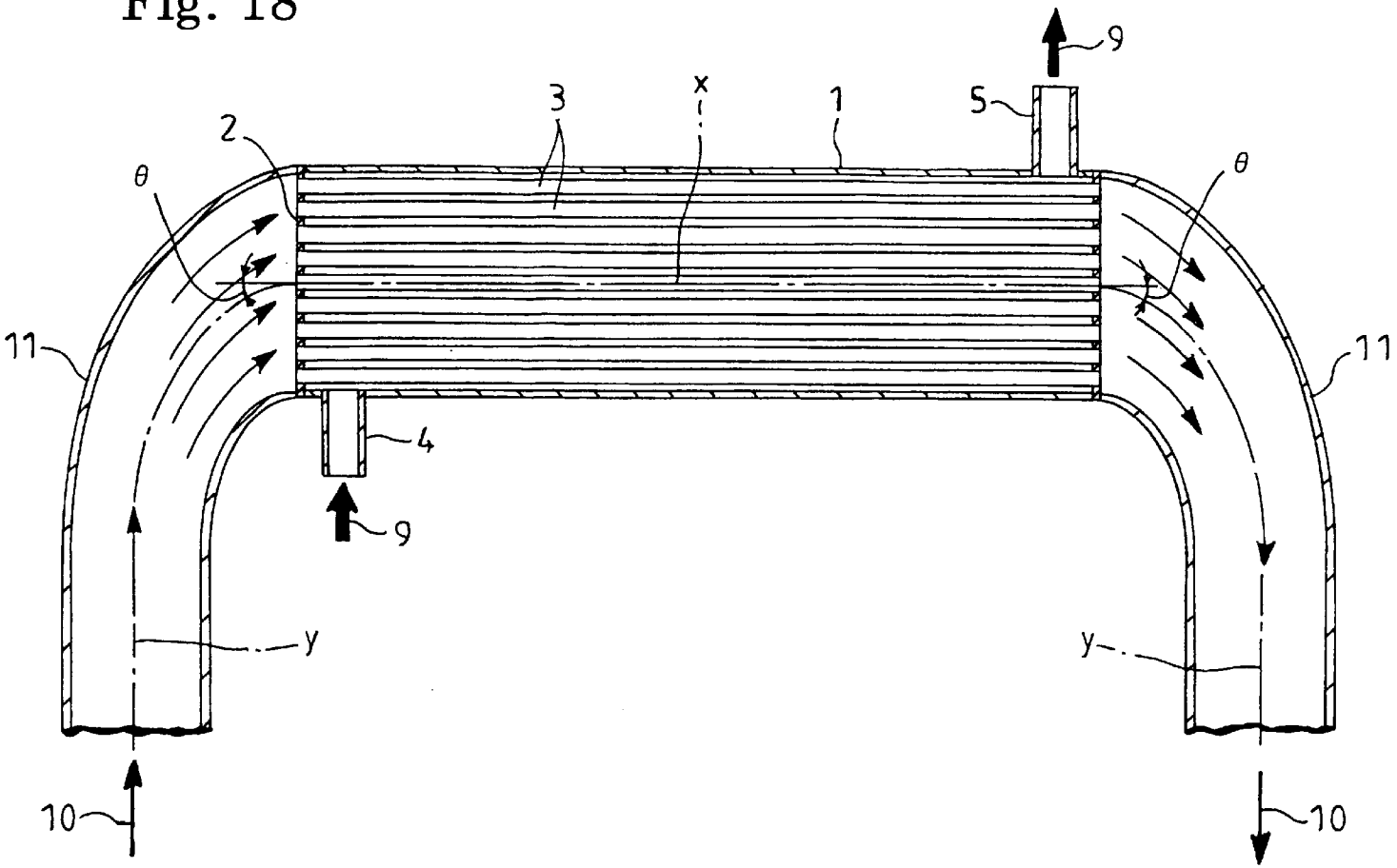
FIG. 18 is a sectional view showing still another embodiment of the present invention.

FIG. 18 shows still another embodiment of the present invention. In this embodiment, with respect to an EGR cooler constructed substantially in the same manner as that described above with reference to FIG. 7, gas pipings 11 extending substantially perpendicular to the axial extension x of the shell 1 are gradually increased in diameter and gradually bent or turned to the axial opposite ends of the shell 1 such that the gas flow does not come off, and is connected to the shell 1 such that the axial extension x of the shell 1 and the axial line y of each gas piping 11 cross each other with a predetermined angle θ.

This smoothly changes the direction of the flow of the exhaust gas 10, which is guided toward the axial one end of the shell 1, such that the exhaust gas forms laminar flow along an inner periphery of the gas piping 11 and that the direction of the flow after being changed is not completely aligned with the axial direction of the shell 1, resulting in collision of the gas flow with uniform flow rate distribution against the plate 2 on the axial one end of the shell 1, whereby the exhaust gas 10 can be introduced and distributed substantially uniformly with no bias to all the tubes 3 while turbulence of the gas flow on the side of the axial one end of the shell 1 is suppressed. On the other hand, the exhaust gas 10 coming out through each tube 3 to the side of the axial other end of the shell 1 is also smoothly changed in direction of flow to form laminar flow along the inner periphery of the gas piping 11 and is smoothly discharged at the outlet portion of each tube 3, without being subjected to local ventilation resistance. As a result, the exhaust gas 10 flows substantially uniformly to all the tubes 3, which averts local high temperature of the tubes 3 and substantially improves the heat exchange efficiency of the exhaust gas 10 with the cooling water 9.

It is to be understood that the EGR cooler according to the invention is not limited to the above-described embodiments and that various modifications and changes may be made without departing from the scope of the invention. For example, though the constructions shown in the respective drawings may be applied individually, any combination thereof may attain synergic effect of improving the heat exchange efficiency of the exhaust gas with the cooling water. Shown in the illustrated examples is a case where the cooling water is in parallel flow to the exhaust gas so as to perform heat exchange; however, heat exchange may be performed in counterflow.

INDUSTRIAL APPLICABILITY

As described above, the EGR cooler according to the invention is suitable for used in attachment to an EGR apparatus which recirculates exhaust gas from an engine to reduce generation of nitrogen oxides.

What is claimed is:

1. An EGR cooler comprising:

a flat box shell having an inlet positioned to introduce cooling water into the flat box shell and an outlet positioned to discharge the cooling water from the flat box shell;

a plurality of plates positioned at axial open ends of the flat box shell so as to close the axial open ends of the flat box shell;

a plurality of hoods positioned at sides of the plates away from the flat box shell so as to enclose end faces of the plates;

a plurality of tubes extending axially within the flat box shell and having ends penetrating through the plates, the tubes being configured to pass exhaust gas through the tubes from one of the hoods to another hood for thermal exchange of the exhaust gas with the cooling water;

a plurality of guide plates arcuately curved from a direction along the axial extension of the flat box shell to outward of longer sides of the end face of the flat box shell and provided in a form of a funnel in one of the hoods on an inlet side of the exhaust gas at a position facing to an exhaust gas inlet; and a round bar positioned at an intermediate position between the guide plates and extending in a direction of shorter sides of the end face of the flat box shell for dividing a main stream of the exhaust gas, wherein the hood on the inlet side of the exhaust gas has a bellmouth form in section, and the bellmouth form has a concave curved portion adjacent to the exhaust gas inlet with abrupt divergency toward the longer sides of the end face of the flat box shell.

* * * * *